United States Patent [19]

Toder

[11] 4,229,857

[45] Oct. 28, 1980

[54] DUAL WHEEL CARRIER FOR USE IN CONJUNCTION WITH CURTAIN TRACK

[76] Inventor: Ellis I. Toder, Fort Washington, Pa.

[21] Appl. No.: 881,394

[22] Filed: Feb. 27, 1978

[51] Int. Cl.[3] ..... A47H 15/00

[52] U.S. Cl. ..... 16/95 R; 16/98; 16/102; 104/89

[58] Field of Search ..... 16/102, 91, 93 D, 97, 16/98, 106, 107, 45–47, 95 R; 160/123, 126, 344–347; 104/102, 108, 89, 91, 94; 105/155; 301/112

[56] References Cited

U.S. PATENT DOCUMENTS

| | | | |
|---|---|---|---|
| 355,521 | 1/1887 | Gould | 16/98 |
| 1,364,592 | 1/1921 | Spicer | 16/98 |
| 1,936,701 | 11/1933 | Wilson | 16/47 |
| 2,148,515 | 2/1939 | Taylor | 104/108 X |
| 2,778,159 | 1/1957 | Irwin | 301/112 X |
| 3,525,306 | 8/1970 | Edel | 105/155 X |
| 3,708,827 | 1/1973 | Foltz | 16/98 |
| 3,854,406 | 12/1974 | Monne | 104/94 |
| 4,141,106 | 2/1979 | Dixon | 16/95 R X |

*Primary Examiner*—Peter P. Nerbun

*Attorney, Agent, or Firm*—Walter B. Udell

[57] ABSTRACT

A hospital curtain track system utilizing a track switch which permits the use of a single privacy curtain selectively for each of a pair of adjacent bed cubicles. The switch and tracks are of two types, one type being a recessed system installable flush with the underside of and as an integral part of an original ceiling installation, and another type being surface mounted installable upward against the underside of an existing ceiling. Self splicing cubicle tracks provide easy assembly and versatility in space planning. One track switch unit between each two bed environment splices directly with the cubicle track and eliminates extra connecting parts including one complete track leg resulting in minimal installation time and expense. The switch utilizes a pull-chain actuated toggle for shifting a horizontally shiftable switch section into alignment with the desired curtain track. Each curtain carrier utilizes a pair of canted wheels which in one embodiment are continuously engaged with and drive one another, both wheels being always engaged with the track to provide a low friction smooth riding non-jammable carrier.

12 Claims, 13 Drawing Figures

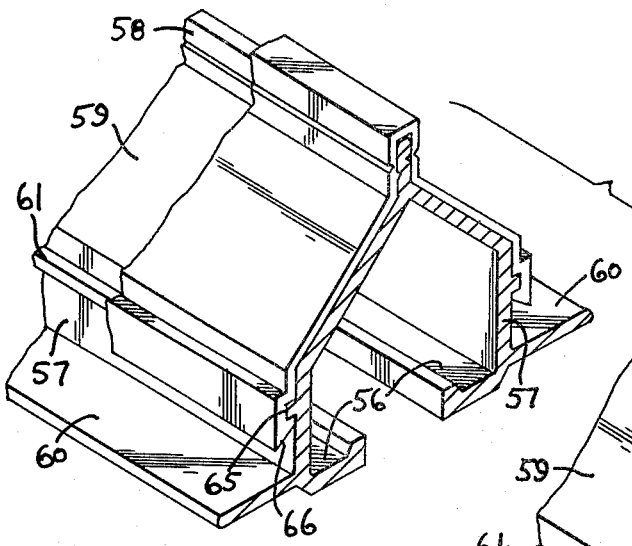
FIG. 10
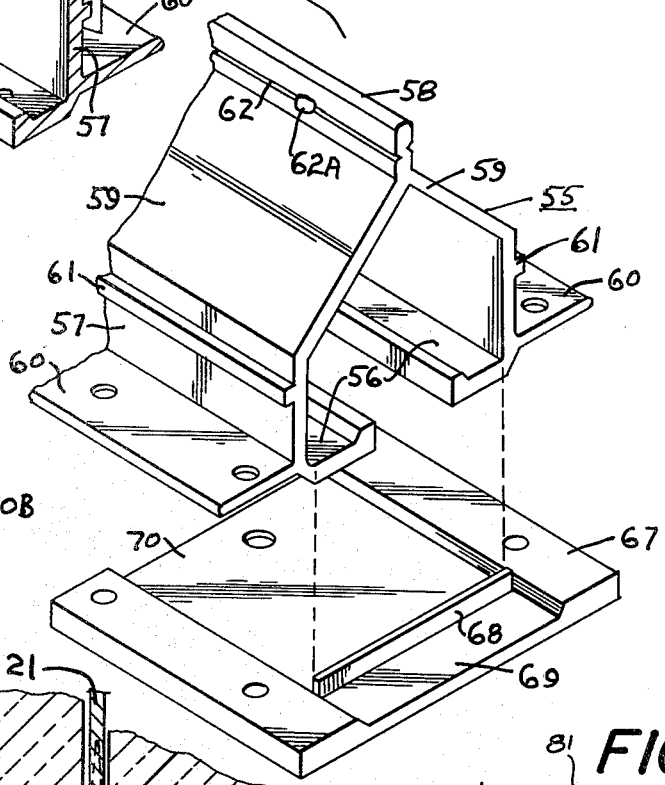
FIG. 8
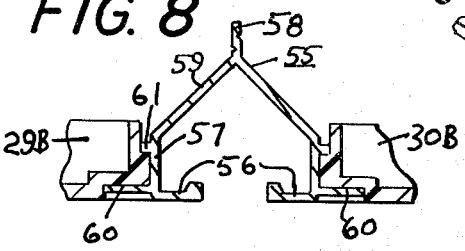
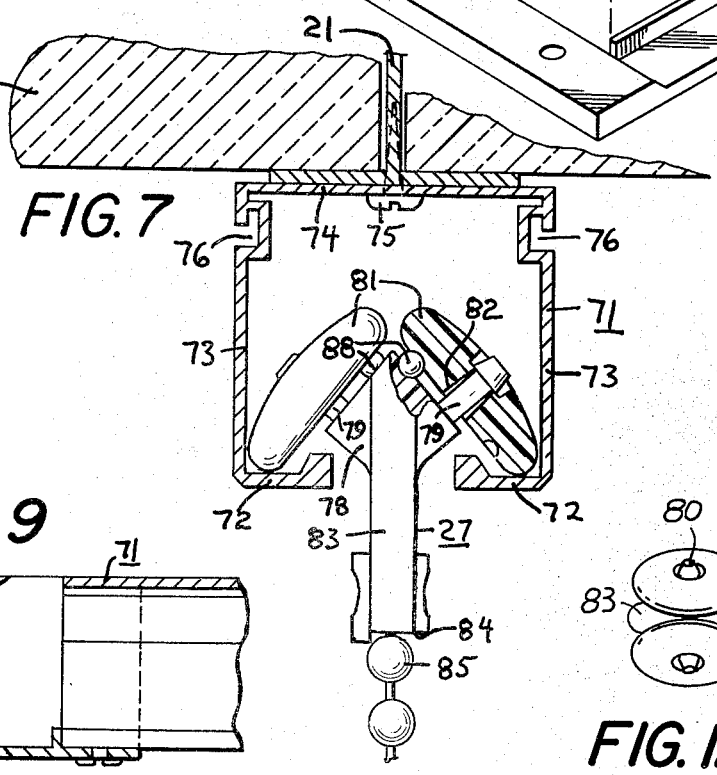
FIG. 7
FIG. 11
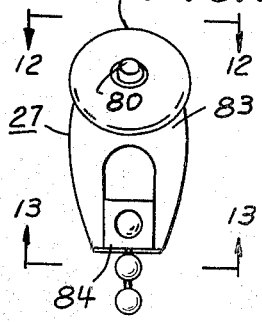
FIG. 9
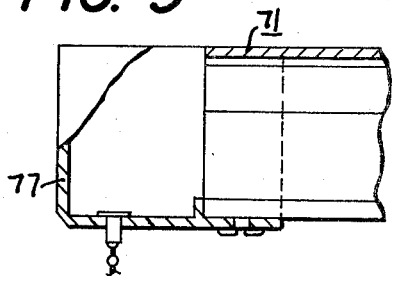
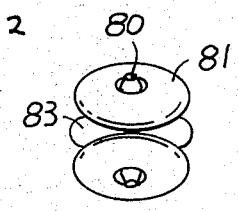
FIG. 12
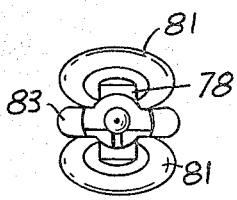
FIG. 13

DUAL WHEEL CARRIER FOR USE IN CONJUNCTION WITH CURTAIN TRACK

This invention relates to privacy curtain track systems and more particularly to a hospital track system utilizing a track switch which permits the use of a single privacy curtain selectively for each of a pair of adjacent bed cubicles. The switch and tracks are of two types, one type being a recessed system installable flush with the underside of and as an integral part of an original ceiling installation, and another type being surface mounted installable upward against the underside of an existing ceiling. The system can of course be used also in residential and commercial drapery installations.

The privacy curtain system is adaptable to multiple bed hospital environments and requires fewer curtains while providing maximum privacy. Self splicing cubicle tracks of various lengths and shapes provide easy assembly and versatility in space planning. One track switch unit between each two bed environment splices directly with the cubicle track and eliminates extra connecting parts including one complete track leg resulting in minimal installation time and expense. The switch utilizes a pull-chain actuated toggle for shifting a horizontally shiftable switch section into alignment with the desired curtain track. Each curtain carrier utilizes a pair of canted wheels, both wheels being always engaged with the track to provide a low friction smooth riding non-jammable carrier. In one particular embodiment the wheels are continuously engaged with and drive one another. The canted wheel arrangement causes the carrier to move in a straight line along the direction of pull without crab walking.

A primary object of the invention is to provide a novel curtain track system which requires only one curtain to provide privacy for a plurality of hospital beds.

Another object of the invention is to provide a novel curtain track system as aforesaid which utilizes a manually actuatable track switch to selectively direct a privacy curtain from one track to another.

A further object of the invention is to provide a novel curtain track system as aforesaid which utilizes novel dual canted wheel non-jammable curtain carriers.

The foregoing and other objects of the invention will become clear from a reading of the following specification in conjunction with an examination of the appended drawings, wherein:

FIG. 7 is a view similar to that of FIG. 6 but for a surface mounted curtain track system and a different dual wheel curtain carrier;

FIG. 8 is a vertical cross-section through the track switch where the common system track is fitted into the switch as would be seen when viewed along lines 8—8 of FIG. 5;

FIG. 9 is a vertical section through the end of a mounted track as shown in FIG. 7, and a partial vertical section through the end cap therefor;

FIG. 10 is an isometric view of the recessed ceiling track showing a track splice connector and an end plate; and FIGS. 11, 12 and 13 are respectively a side elevational view, a top view and a bottom view of the canted wheel carrier shown in end elevation and partial section in FIG. 6.

In the several figures, like elements are denoted by like reference characters.

Figure 1:
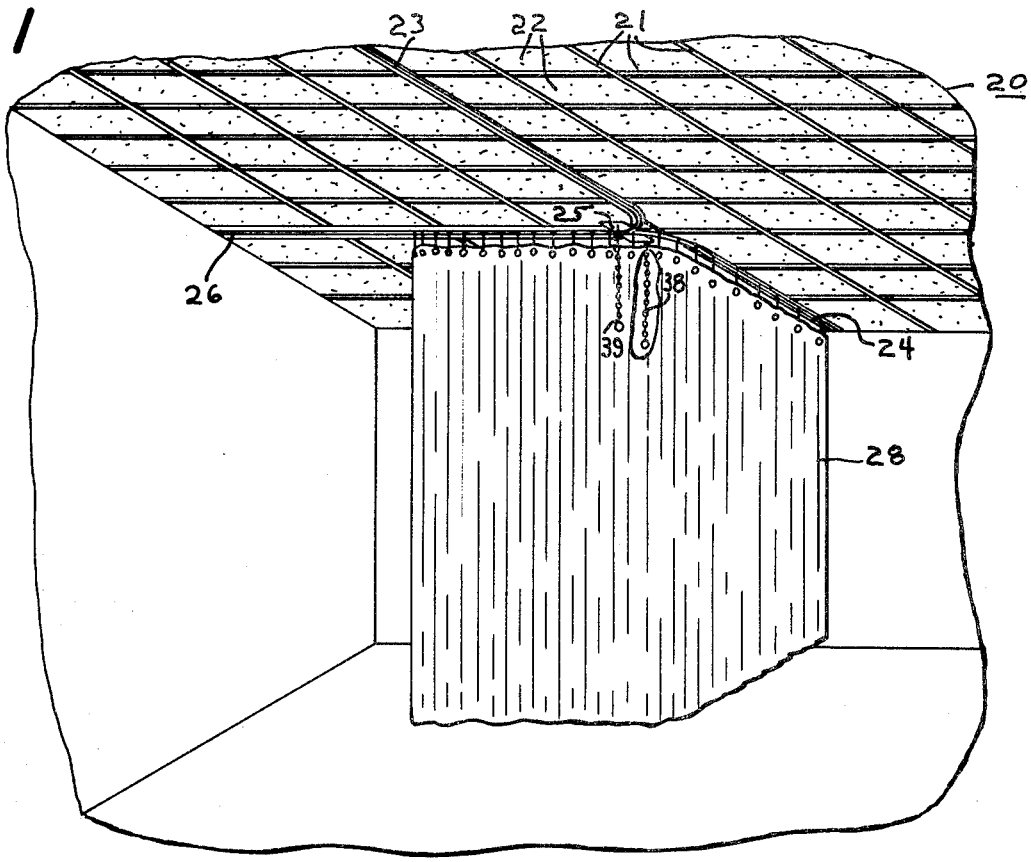
FIG. 1 is an isometric view of the novel ceiling recessed curtain track system according to the invention.
Figure 2:
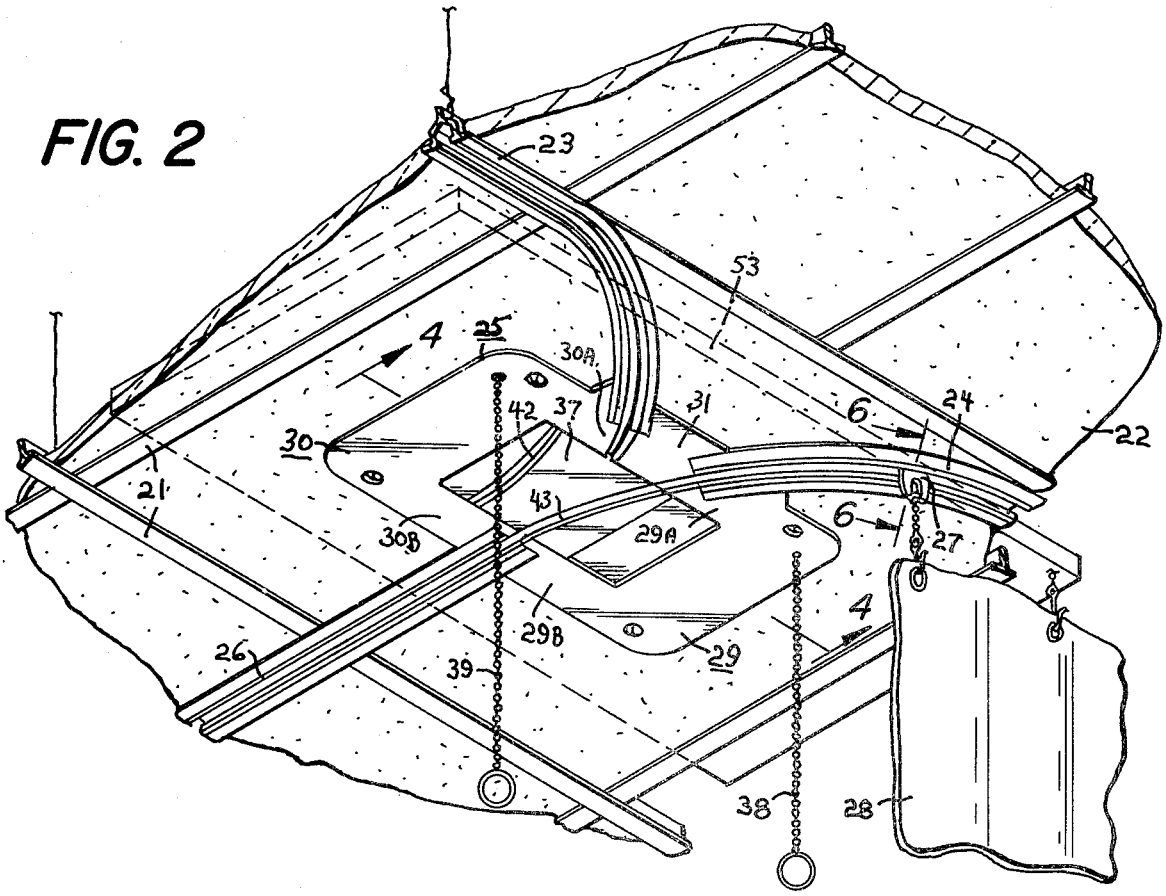
FIG. 2 is a fragmentary isometric view of the curtain track system in the region of the track switch.

Referring now to the drawings, and first to FIGS. 1 and 2, there is observed a room, which typically could be a hospital room, having a suspended ceiling 20 consisting of a plurality of the usual T-bar supports, designated generally as 21, which support a plurality of ceiling panels 22. In place of one of the T-bars 21 are a pair of curtain tracks 23 and 24 which are flush mounted in the ceiling and function not only as curtain tracks but also as an integral part of the suspended ceiling support grid. The two curtain tracks 23 and 24 are shown as co-linearly alined, and as they approach each other curve out of alinement and inward into engagement with a track switch 25. A third curtain track 26 extends outward from the track switch 25 substantially orthogonally to the running length of the curtain tracks 23 and 24, and also forms part of the ceiling support grid. Suspended from the track system by carriers 27 is a curtain 28 which, as seen in FIG. 1, forms a cubicle when extended along the tracks 24 and 26 through the switch 25, and which forms a second cubicle, not shown, when the curtain is extended along tracks 23 and 26 through the switch 25.

Figure 3:
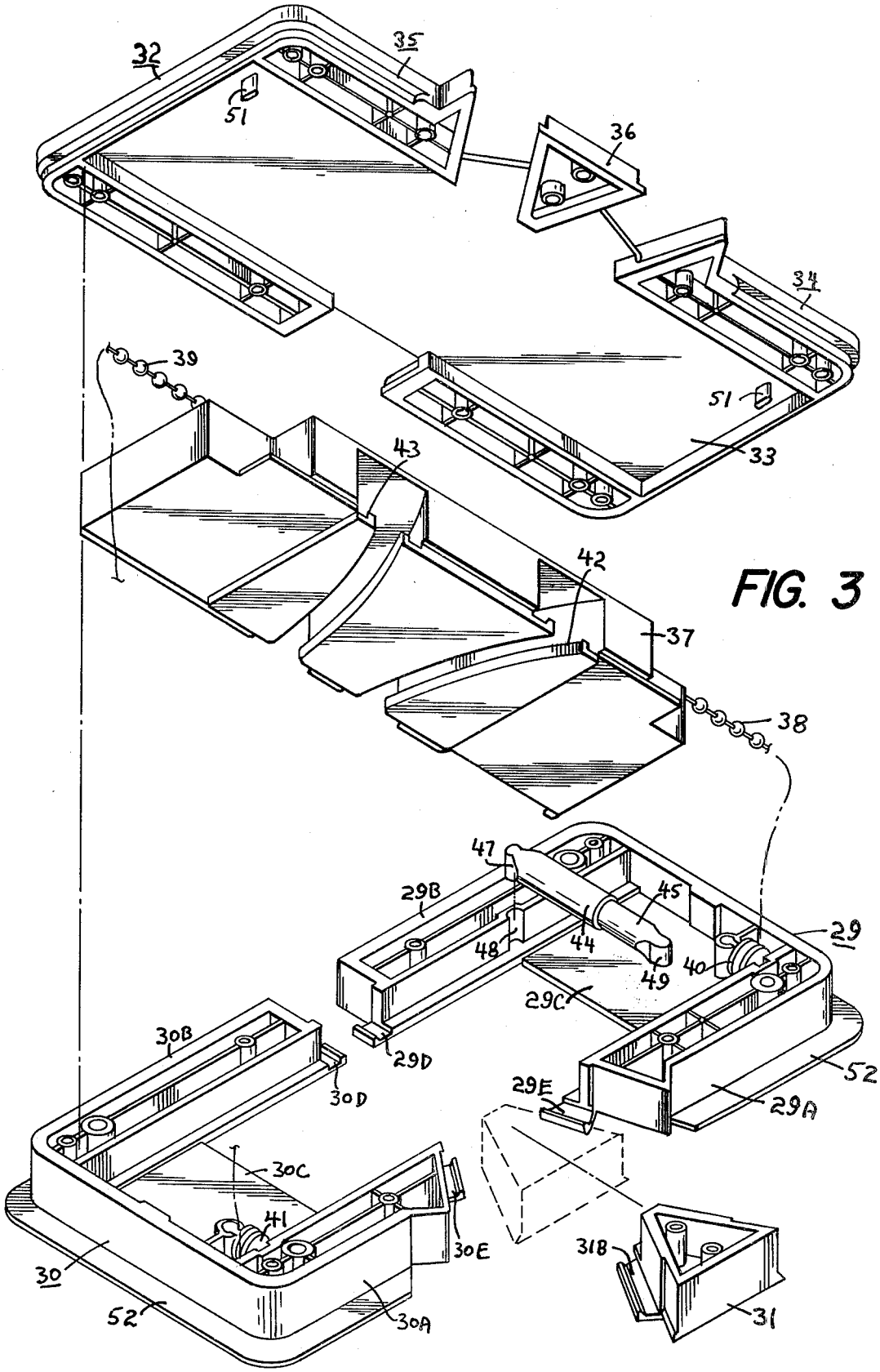
FIG. 3 is an exploded isometric view of the track switch.

As best seen in FIGS. 2 and 3, the track switch 25 is seen to have a pair of symmetrical bottom or lower outer sections 29 and 30 of generally C-shape or U-shape, and a generally truncated triangularly shaped section 31 spaced between legs 29A and 30A of the outer sections 29 and 30. As best seen in FIG. 3, the switch has a top section 32 having a top closure plate 33 from which depend a pair of outer sections 34 and 35 which are congruent with and matingly overlie the bottom outer sections 29 and 30 respectively, and also has a top triangular section 36 which congruently matingly overlies the bottom triangular section 31. A generally rectangular dual track switch slider 37 is held slidably captive between the top plate 33 and the bottom plates 29C and 30C of the lower outer sections 29 and 30. Secured to the slider 37 are a pair of ball chain pulls 38 and 39, the chain 38 being trained around pulley 40 and extending downward through an aperture in the bottom outer section 29, while the chain 39 is similarly trained around a pulley 41 and extends downward through an aperture in the bottom outer section 30.

Figure 5:
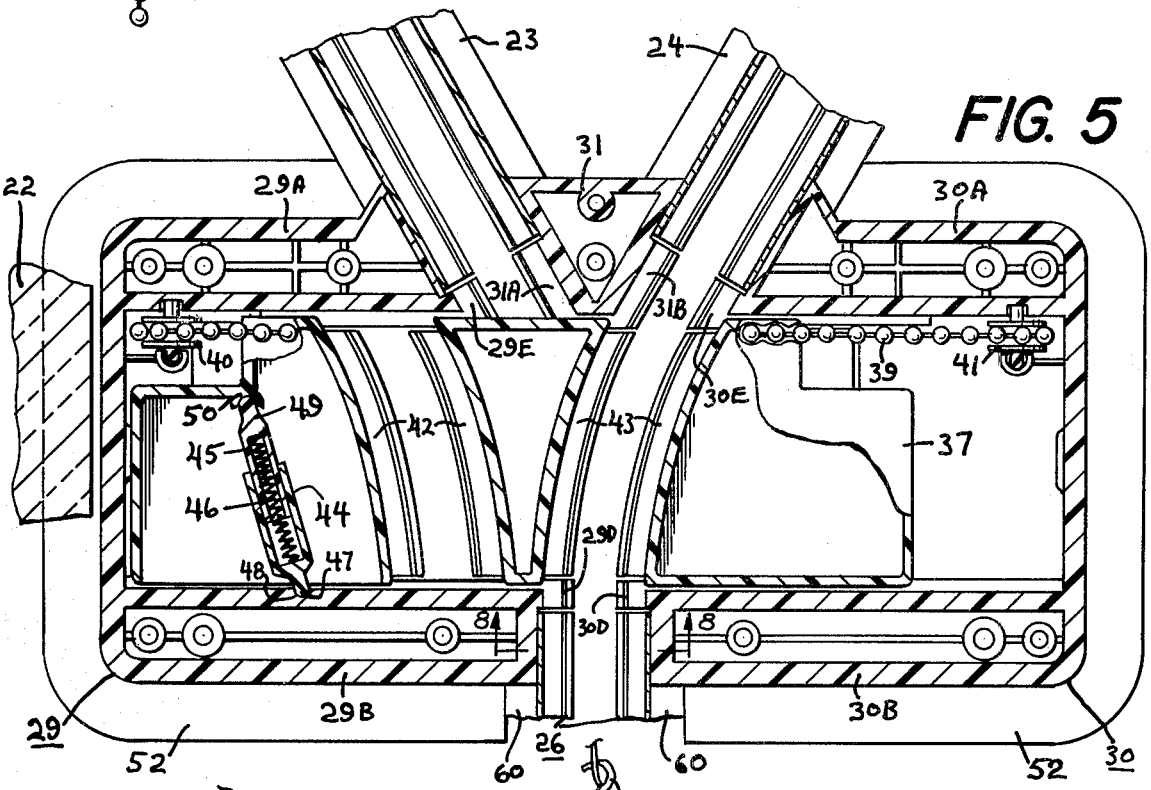
FIG. 5 is a horizontal sectional view through the track switch as would be seen when viewed along lines 5—5 of FIG. 4.

As best seen in FIG. 2, the lgs 29B and 30B of the bottom outer sections 29 and 30 form an opening into which the end of the common track 26 fits precisely and accurately, this opening also being shown in FIG. 5 with a portion of the end of track 26 disposed therein with the actual tracks 56 on which the wheels of the curtain carriers 27 ride being alined with track portions 29D and 30D formed respectively on the ends of legs 29B and 30B of the bottom outer sections 29 and 30. In a similar manner, a pair of branch track openings to receive the ends of the tracks 23 and 24 are formed between the ends of legs 29A and 30A of the bottom outer sections 29 and 30 and the bottom triangular section 31. Track sections 29E and 31A form continuations of the carrier tracks of curtain track 23, while track portions 30E and 31B form the track continuations for the track portions of curtain track 24.

The switch slider 37 is formed with a pair of curved track sections 42 and 43 which respectively connect the common track opening for track 26 with the branch track openings for tracks 23 and 24 as a function of the position of the switch slider 37. As shown in FIG. 5 of the drawings, with one end of the switch slider against the end wall of bottom outer section 29, the curved switch slider track section 43 forms a continuous smooth track connecting section between branch track 24 and common track 26. When the switch slider 37 is shifted to the right so that the end disposed within the bottom outer section 30 is stopped by the end wall of section 30, then switch slider track section 42 forms a continuous track connection between track 23 and common track 26. Shifting of the switch slider 37 from one switch position to the other is accomplished by pulling downward on the ball chain pulls 38 and 39, downward pull on chain 38 causing the switch to assume the condition shown on FIG. 5, whereas pulling downward on ball chain 39 causes the switch slider 37 to move laterally and connect tracks 23 and 26 by means of the curved track section 42.

The switch slider 37 remains in stable switch position because of the over-center toggling action of a spring toggle formed by an outer cylindrical telescopic section 44 and an inner section 45 with a compression spring 46 held captive within and between the inner and outer telescopically engaged toggle cylindrical sections 44 and 45. The free end of outer cylinder 44 is formed in the shape of a semi-circular cylindrical section 47 which seats in pivotal fashion in a semi-circular cylindrical socket 48 molded on the inner surface of leg 29B of bottom outer section 29. Similarly, the free end of toggle inner telescopic section 45 is similarly formed with a semi-circular cylindrical end section 49 which fits pivotally smoothly into a semi-circular cylindrical socket 50 formed on the inside of the switch slider 37, as best seen in the showing of FIG. 5. The pivot end 47 is the fixed pivot while the pivot end 49 is the floating pivot, which latter turns within socket 50 and swings over toward the right as the slider 37 moves to the right under the urging of pull chain 39, the pivot end 47 pivoting within the socket 48 but undergoing no translational or shifting movement.

Figure 4:
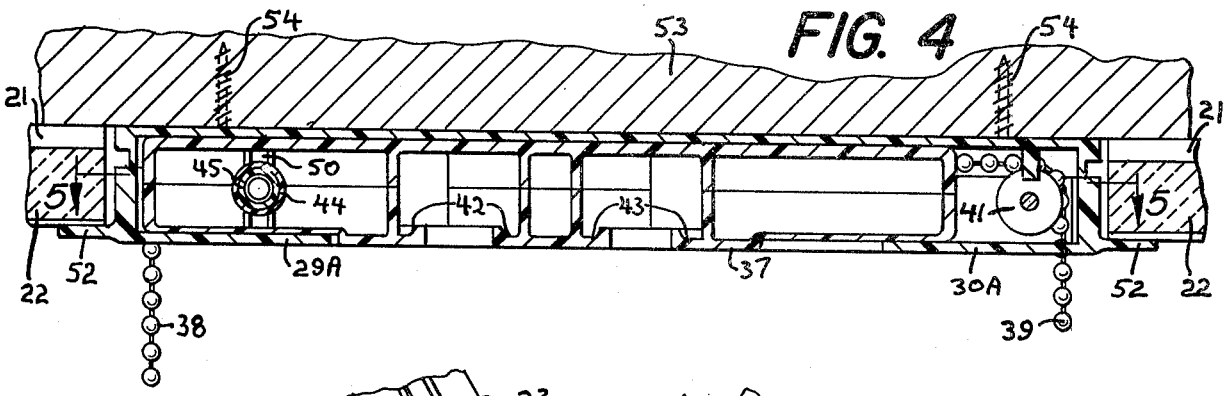
FIG. 4 is a vertical sectional view through the track switch as would be seen when viewed along lines 4—4 of FIG. 2.

The pull chains 38 and 39 are restrained from lateral movement off of their associated pulleys 40 and 41 by being held captive laterally between the side guide posts 51 which depend from the top plate 33 and the adjacent inner edges of the top outer sections 34 and 35. The switch 25 is also provided with a peripherally extending flange 52 which underlies the adjacent parts of the ceiling which have been cut out so that the switch may be upwardly recessed for flush mounting with the ceiling undersurface. A switch support plate is positioned above the switch 25 and overlying a pair of adjacent T-bar supports 21, as best seen in FIGS. 2 and 4, to carry and support the mass of the switch 25 and provide sufficient mechanical support to oppose the downward pull exerted by chains 38 and 39 which actuate the switch mechanism, the support plate being designated as 53, and the switch being shown secured thereto in FIG. 4 by the screws 54. While the switch may be made in any desired fashion, it is illustrated as being formed of molded plastic to provide a minimum weight.

Figure 6:
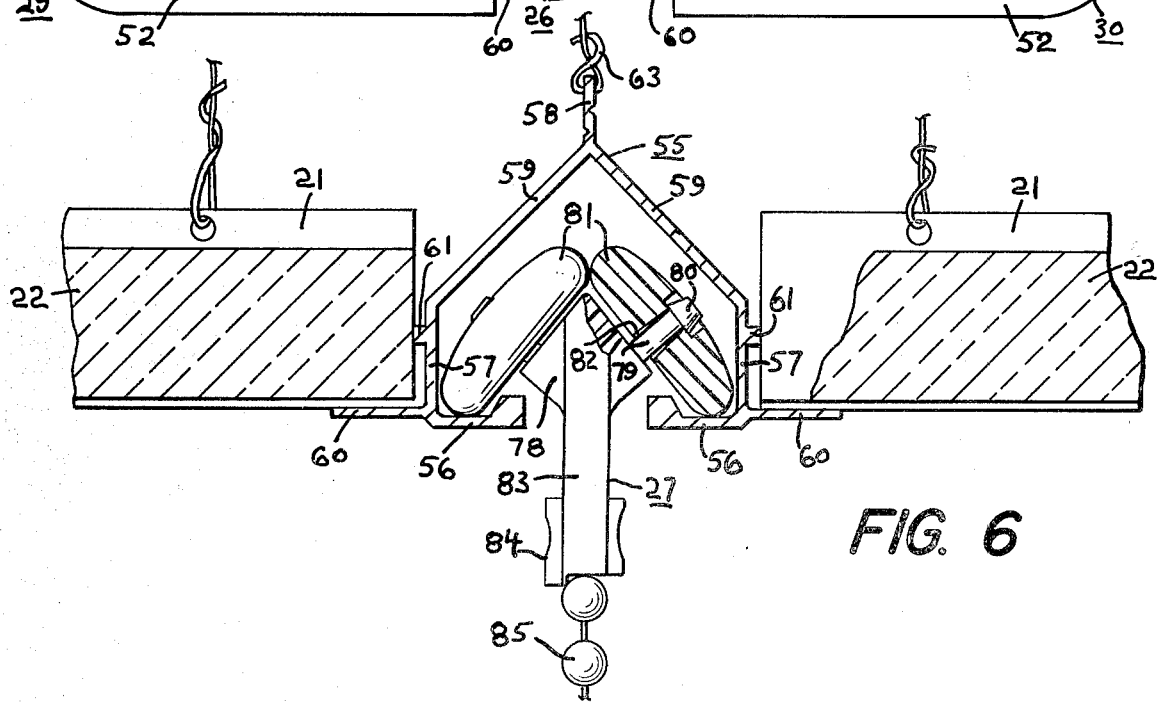
FIG. 6 is a vertical sectional view through a portion of the track section as would be seen when viewed along lines 6—6 of FIG. 2, one wheel of the curtain carrier being also sectioned.

The recessed track used with the illustrated flush mount switch 25 is best seen in FIGS. 6, 10 and 8, the latter figure showing a detail of the interfit of the track with the switch body to illustrate the interlocking arrangement which maintains the track sections immovably interfitted with the switch for optimum operation. The track, designated generally as 55 has a pair of spaced apart lower parallel extending track formations 56 supported by the vertically upstanding sidewall sections 57 which latter are joined to a longitudinally extending vertically upstanding top rib 58 by a pair of upwardly sloping converging topwalls 59. Extending laterally outwardly from each of the sidewalls 57 are bottom flanges 60 and longitudinally extending side ribs 61. The top rib 58 is provided with a plurality of longitudinally extending grooves 62 which function as drill bit starting indices through which are drilled spaced wire tie holes 62A by means of which the track 55 is supported from the above-lying structure by means of wire ties 63, this arrangement being illustrated in the showing of FIG. 6 in which it is observed how the track 55 is interfitted with and functions as one of the ceiling structure T-bar supports.

The showing of FIG. 10 illustrates the manner in which track sections 55 may be end abutted and spliced together by means of splice plates 64. The splice plate 64 is shaped to closely overlie a portion of each of the vertical sidewalls 57 and the side ribs 61 carried thereby, the converging top walls 59 and the top rib 58. The splice plate 64 includes longitudinally extending splice plate groove formations 65 which closely surround and conform to the outer shape of the track side ribs 61, with each of the lower terminating longitudinally extending edges of the splice plate 64 being formed to have an inwardly upwardly sloping bottom camming edge 66.

Splicing is achieved by taking a section of splice plate 64 and pressing it vertically downward over a pair of end abutted tracks 55 until the bottom camming edges 66 engage the upper edges of the side ribs 61. Continued downward pressure then cams the splice plate sides outward until the bottom camming edges 66 pass beyond the track side ribs 61 and the plate then snaps inward so that the splice plate grooves 65 close fittingly surround the ribs 61 and hold the adjacent abutted tracks firmly together by means of the strong frictional engagement of the splice plate with each of the abutting track sections.

Also shown in FIG. 10 is an end stop plate 67 which fits closely beneath the track 55 so that the upstanding transverse end abuttment 68 extends upward and flush against the ends of the track formations 56 to act as an end index for the stop plate. The stop plate end flange 69 functions as a ceiling panel cutout cover in the same way as the track bottom flanges 60. The curtain carriers 27 are stopped by abuttment with the end plate inner edge 70. The end stop plate 67 is of course securable to the track by any convenient means such as by self tapping sheet metal screws which are not shown.

A modified form of cubicle track is shown in FIG. 7 in which a track 71 of generally square cross-section is shown having bottom track formations 72, vertical sidewalls 73 and a horizontal top wall 74, the track being secured upward against the underside of a T-bar 21 by means of the sheet metal screw 75. The configuration and spacing of the track formations 72 are the same as that of the track formations 56 of the flush type track 55 previously described, so that the curtain carriers 27 are usable with either form of track. The square cross-section track 71 is installable on the undersurface of ceilings which are already installed and is utilized in conjunction with a curtain track switch which is functionally identical to the track switch 25 previously described, but which, if desired, may be made without the bottom flange 52 since there is no functional requirement for the flange.

The square cross-section tracks 71 may also be spliced together by means of splice plates, not shown, which interlock a pair of end-abutted tracks 71 by overlying the adjacent top walls 74 and the upper parts of the sidewalls 73 with ribs which project into and lock with the track sidewall upper recesses 76. As best seen in the showing of FIG. 9, an end closure 77 is securable to the end of the track 71 in any convenient manner as for example by means of screws or rivets, and also acts as a stop for the curtain carriers 27.

Returning now to the showing of FIG. 6, the carrier 27 is seen to include a carrier block 78 from which divergingly upwardly extend in a common plane a pair of axles 79 which latter terminate in a frusto-conical end formation 80 having the larger conical base closest to the carrier block 78 and of larger diameter than the axles 79. The axles 79 are orthogonal to each other and oriented forty-five degrees to the horizontal and vertical directions. Wheels 81 are mounted on the axles 79 with the axle receiving bores 82 being of frusto-conical cross-section with the opening closest to the carrier block 78 being of larger cross-sectional area than the axles 79 and converging to the size of the axle just inward of the frusto-conical axle end formations 80.

The wheels 81 are forced onto the axles 79 by pressing them inward past the end formations 80, which latter then restrain the wheels 81 from moving outward on the axles 79. The thickness of the wheels 81 is such that when mounted upon the shaft 79 there is a clearance between the carrier block 78 and the inner surface of the wheel 81. Additionally, the wheels 81 engage one another at their upper ends so that as one wheel rotates in a given direction its frictional engagement with the other wheel drives the other wheel in the same direction. Accordingly, each of the wheels drives the other which prevents twisting or cocking of the carrier 27 within the track.

It is also observed that the outer surfaces of the lower ends of the wheels 81 are spaced slightly away from the inside surfaces of the track walls 57, and the inside surfaces of the wheels 81 do not engage the inner edges of the tracks 56. As a consequence of this construction, the wheels 81 ride on the horizontal surfaces 56 of the track with freedom to move slightly laterally, and therefore never laterally bind within the track structure. Depending from the carrier block 78 is a stem 83 which terminates at its lower end in a chain holder 84 within which is replaceably secured a curtain support chain 85. FIGS. 11, 12 and 13 are respectively side, top and bottom views of the carrier shown in end elevation and partial section in FIG. 6.

A slightly modified carrier 27 is illustrated in FIG. 7, the parts being identical except for two differences. In the showing of FIG. 7, the upper bearing for the carrier wheels 81 is not provided by having the wheels engage one another, but is provided by having the inside surfaces of each wheel bear against a ballbearing 88 seated in a socket formed in the carrier block 78 proximate to its upper edge. The ball bearings 88 engage the inside surfaces of the wheels 81 and ride within a circular groove 89 formed on the wheel inside surfaces. In both cases, the double bearing supports for the wheels 81 provide a mechanically strong and stable structure.

While the axles 79 are shown in FIGS. 6 and 7 as being orthogonal to one another, it is not absolutely mandatory that the angle between the axles be precisely ninety degrees. Other angles could be used if desired. However, significantly smaller angles increase the bearings loads and widen the track with no apparent offsetting benefit, while significantly larger angles can increase the required track height and decrease the upper bearings loads which is extreme cases could cause the wheels in the embodiment of FIG. 6 to slip relatively to one another.

Having now described my invention in connection with particularly illustrated embodiments thereof, it will be apparent that variations and modifications may now occur from time to time to those persons normally skilled in the art without departing from the essential scope or spirit of my invention, and accordingly it is intended to claim the same broadly as well as specifically as indicated by the appended claims.

What is claimed to be new and useful is:

1. A dual wheel carrier for use in conjunction with an underlying carrier track consisting of a pair of parallel longitudinally extending spaced apart tracks, said carrier comprising in combination, (a) an axles support from which extend divergingly upward a pair of axles, and from which depends means for attaching an item to be carried, and (b) a wheel mounted on each of said axles for rotation, the lowest points of said wheels being spaced apart the proper distance so that each wheel is seatable on and rideable along a different one of the spaced apart tracks of the aforesaid carrier track, said wheels converging toward one another at their upper edges.

2. A dual wheel carrier as described in claim 1 further including a rolling bearing for each said wheel, said bearings being positioned at locations closer to each other than are the locations of the bearings of the wheels on the axles and than are the contacts of the wheels with the underlying tracks.

3. A dual wheel carrier as described in claim 1 wherein said axles are non-rotatably fixed to said axles support and said wheels are centrally apertured to receive said axles therethrough, said central wheel apertures being of frustoconical shape with the smaller base being of substantially the same diameter as said axle and located proximate to the outer face of the wheel while said wheel aperture larger base is larger than the axle diameter and located at the inner face of the wheel.

4. A dual wheel carrier as described in claim 1 wherein each said axle is provided on its outer end with a resiliently deformable wheel retainer formation of larger diameter than the axle, and each said wheel is forced onto said axle until said wheel retainer passes the outer end of said wheel central aperture.

5. A dual wheel carrier as described in claim 1 wherein said pair of axles are orthogonal to each other and in use are oriented at forty five degrees to the horizontal plane of the tracks on which the wheels of said carrier are rideable.

6. A dual wheel carrier as described in claim 2 wherein said wheels are of such diameter that when mounted on said axles they converge at their upper edges into engagement with one another, said engagement constituting said rolling bearing.

7. A dual wheel carrier as described in claim 2 wherein said rolling bearing comprises a ball bearing journalled in said axles support and engaged with the wheel face closest to said axles support.

8. A dual wheel carrier as described in claim 2 wherein said rolling bearing comprises a ball bearing journalled in said axles support and engaged with the wheel face closest to said axles support, which wheel face is circularly annularly grooved to receive therein a portion of said ball bearing surface.

9. A dual wheel carrier as described in claim 2 wherein said axles are non-rotatably fixed to said axles support and said wheels are centrally apertured to receive said axles therethrough, said central wheel apertures being of frustoconical shape with the smaller base being of substantially the same diameter as said axle and located proximate to the outer face of the wheel while said wheel aperture larger base is larger than the axle diameter and located at the inner face of the wheel.

10. A dual wheel carrier as described in claim 2 wherein each said axle is provided on its outer end with a resiliently deformable wheel retainer formation of larger diameter than the axle, and each said wheel is forced onto said axle until said wheel retainer passes the outer end of said wheel central aperture.

11. A dual wheel carrier as described in claim 9 wherein said axles are co-planar and said wheels are of such diameter that when mounted on said axles they converge at their upper edges into engagement with one another, said engagement constituting said rolling bearing.

12. A dual wheel carrier as described in claim 9 wherein said axles are co-planar and said rolling bearing comprises a ball bearing journalled in said axles support and engaged with the wheel face closest to said axles support.

* * * * *